US009187971B2

(12) United States Patent
Hutchinson

(10) Patent No.: US 9,187,971 B2
(45) Date of Patent: Nov. 17, 2015

(54) OILFIELD DOWNHOLE WELLBORE SECTION MILL

(71) Applicant: Baker Hughes Incorporated, Houston, TX (US)

(72) Inventor: Floyd J. Hutchinson, Gray, LA (US)

(73) Assignee: BAKER HUGHES INCORPORATED, Houston, TX (US)

( * ) Notice: Subject to any disclaimer, the term of this patent is extended or adjusted under 35 U.S.C. 154(b) by 289 days.

(21) Appl. No.: 13/886,020

(22) Filed: May 2, 2013

(65) Prior Publication Data

US 2013/0292108 A1 Nov. 7, 2013

Related U.S. Application Data

(60) Provisional application No. 61/643,198, filed on May 4, 2012.

(51) Int. Cl.

| | |
|---|---|
| ***E21B 29/06*** | (2006.01) |
| ***E21B 29/00*** | (2006.01) |
| *E21B 10/32* | (2006.01) |

(52) U.S. Cl.
CPC ..... *E21B 29/005* (2013.01); *E21B 10/325* (2013.01)

(58) Field of Classification Search
CPC ..... E21B 10/32; E21B 10/322; E21B 10/325; E21B 10/66; E21B 29/00; E21B 29/002; E21B 29/005
See application file for complete search history.

(56) References Cited

U.S. PATENT DOCUMENTS

| | | | | |
|---|---|---|---|---|
| 2,899,000 | A * | 8/1959 | Medders et al. | 166/55.8 |
| 4,938,291 | A | 7/1990 | Lynde et al. | |
| 5,010,955 | A | 4/1991 | Springer | |
| 5,150,755 | A * | 9/1992 | Cassel et al. | 166/297 |
| 5,253,714 | A * | 10/1993 | Davis et al. | 166/376 |
| 5,265,675 | A | 11/1993 | Hearn et al. | |
| 5,402,856 | A * | 4/1995 | Warren et al. | 175/57 |
| 5,732,770 | A * | 3/1998 | Beeman | 166/55.8 |
| 5,791,409 | A | 8/1998 | Flanders | |
| 6,070,677 | A | 6/2000 | Johnston, Jr. | |
| 6,209,645 | B1 | 4/2001 | Ohmer | |
| 6,595,302 | B1 * | 7/2003 | Diamond et al. | 175/65 |
| 6,679,328 | B2 | 1/2004 | Davis et al. | |
| 6,877,564 | B2 | 4/2005 | Layton et al. | |
| 6,957,703 | B2 | 10/2005 | Trott et al. | |
| 7,306,056 | B2 | 12/2007 | Ballantyne et al. | |
| 7,909,100 | B2 | 3/2011 | Bryant, Jr. et al. | |
| 8,162,066 | B2 | 4/2012 | Farmer et al. | |
| 2011/0220357 | A1 | 9/2011 | Segura et al. | |
| 2011/0240367 | A1 | 10/2011 | Guidry et al. | |

OTHER PUBLICATIONS

Baker Oil Tools Field Report, Shell Offshore Extended Reach Section Mill Test Sep. 2008, 1-15.

* cited by examiner

*Primary Examiner* — Giovanna C Wright
*Assistant Examiner* — Tara Schimpf
(74) *Attorney, Agent, or Firm* — Steve Rosenblatt

(57) ABSTRACT

A section mill features extendable cutting blades and centering blades that are pressure actuated for sequential extension of the centering blades before the cutting blades. Applied pressure results in flow through a flow restriction that creates a force on return springs associated with the centering and the cutting blades. The springs allow extension of the centering blades before the cutting blades. Another spring returns a mandrel to the run in position on cessation of flow. The blades are extended or retracted with a rack and pinion drive system.

17 Claims, 6 Drawing Sheets

OILFIELD DOWNHOLE WELLBORE SECTION MILL

This application is claims priority from U.S. Provisional Patent Application Ser. No. 61/643,198, filed on May 4, 2013, the disclosure of which is incorporated herein by reference in its entirety.

FIELD OF THE INVENTION

The present invention relates to the field of gas and petroleum exploration and production and, more particularly, to cutting and milling tubular, such as casing in the well bore.

BACKGROUND OF THE INVENTION

In the offshore industry, the exploration and production of gas and petroleum is conducted through tubular (casing) of various diameters. The wellbore typically includes casing that extends downwardly for several thousand yards. When the well is abandoned, the owners of the wellbore are required to perform an operation called plugging and abandonment. Federal regulations and guidelines require that the well bore be sealed, entailing the removal of some existing casing to place a plug. Conventionally, the cutter in use can cut and mill the innermost section of casing. However, cutting larger diameter casing still existing lower in the well bore must still be performed by a smaller diameter tool because the operator has to negotiate through the smallest inner diameter ("I.D.") restriction of casing before the larger casing downhole is reached. In addition, the inner and outer casing may not be concentric, forcing the cutter to have to go through the smaller inner casing and exit through a cut section before cutting and milling the larger casing without being able to center the cutter in the larger casing. This painstaking and costly process can take several days, if it can be done at all without the removal of the restriction.

Devices that hydraulically actuate stabilizers and cutting blades with tubing pressure are disclosed in U.S. Pat. No. 5,265,675 and U.S. Pat. No. 6,679,328. Rack and pinion drive systems for downhole tools are shown in U.S. Pat. Nos. 6,877,564; 6,957,703 and 8,162,066.

As can be seen, there is a need for a device that can cut and mill tubular of various inside diameters in an efficient manner, thereby saving time and expense.

SUMMARY OF THE INVENTION

A section mill features extendable cutting blades and centering blades that are pressure actuated for sequential extension of the centering blades before the cutting blades. Applied pressure results in flow through a flow restriction that creates a force on return springs associated with the centering and the cutting blades. The springs allow extension of the centering blades before the cutting blades. Another spring returns a mandrel to the run in position on cessation of flow. The blades are extended or retracted with a rack and pinion drive system.

DETAILED DESCRIPTION OF THE PREFERRED EMBODIMENT

Figure 1:
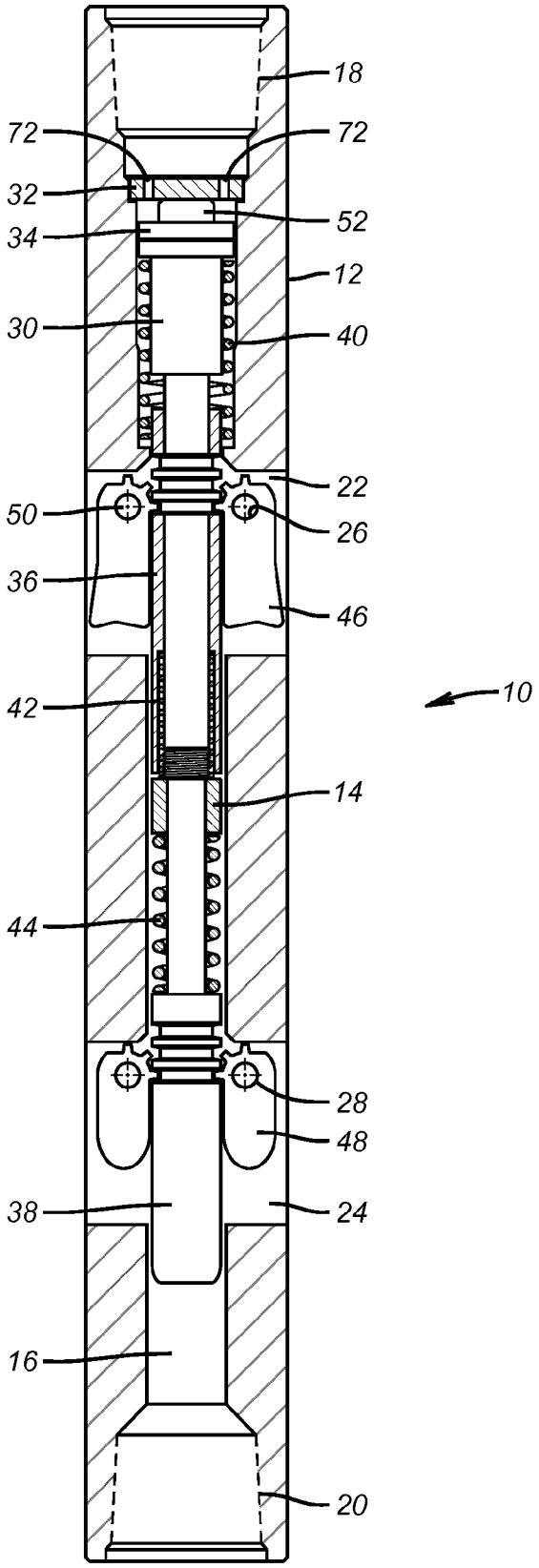
FIG. 1 is a cross-sectional view of an exemplary embodiment of a cutting tool of the present invention and its components.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a well bore section mill for use in restricted, eccentric casing conditions.

Referring now to FIGS. 1 through 6, FIG. 1 is a cross-sectional view of an exemplary embodiment of a cutting tool or apparatus 10 of the present invention. The cutting tool 10 comprises an elongated, hollow cutter body 12 with upper and lower sets of three or more longitudinal slots 22 and 24 formed in the side wall of the body 12. The slots 22 and 24 are open to the interior 16 of the body 12. The upper portion of the body 12 is adapted for detachable connection with a top bushing 70 (FIG. 3) which transmits rotational force to the body 12 from an outside source. The bushing 70 and the body 12 are connected by matingly engageable threads 18. The lower portion 73 of the body 12 is provided with inner threads 20 for connecting the body 12 to tubular bodies positioned in the well below the tool 10.

Figure 2A:
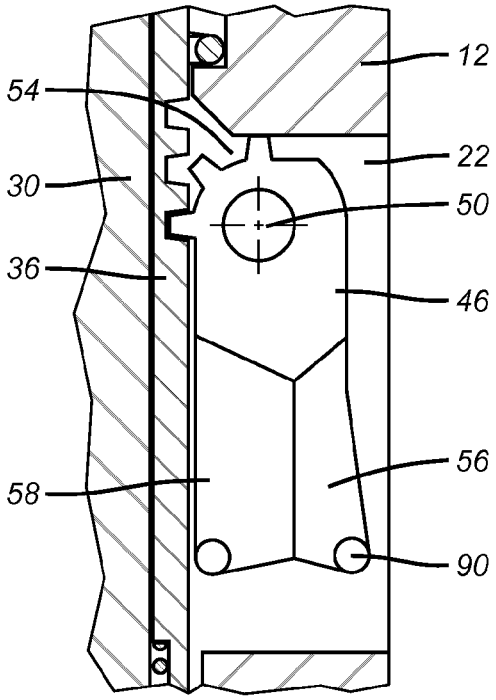
FIGS. 2*a* and 2*b* illustrate cross-sectional views of cutting blades of the tool of FIG. 1 in the recessed and extended positions, respectively.
Figure 2B:
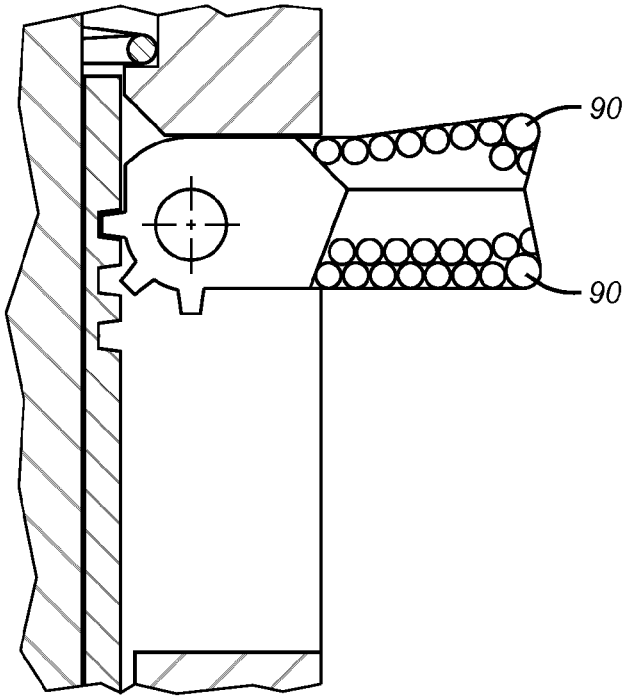

As illustrated in FIG. 2, a set of cutting blades or knives 46 are pivotally secured to the body 12. In the idle position, the cutting blades 46 are recessed into the slots 22 in a generally parallel orientation to the longitudinal axis of the body 12. Each of the cutting blades 46 has an elongated, rectangular cross section. Each cutting blade 46 has openings 26 for receiving pivot pins 50. Each cutting blade 46 has teeth 54 on its heel. An extended bottom portion of each cutting blade 46 is dressed with carbide inserts 90 with a cut out side 56 and a milling edge 58.

Figure 4A:
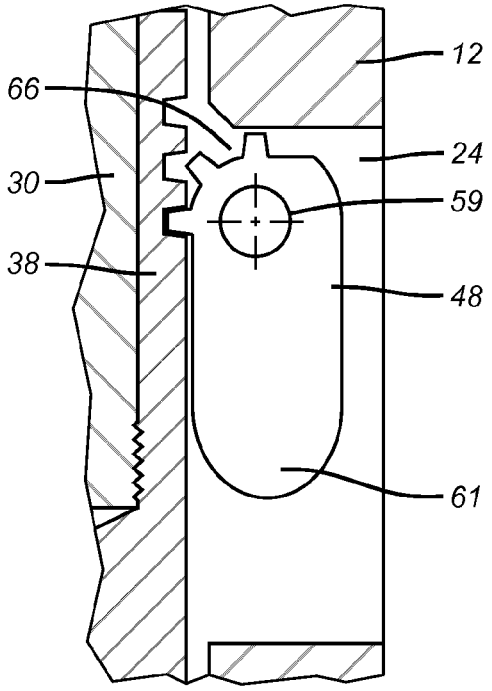
FIGS. 4*a* and 4*b* illustrate cross-sectional views of centering blades of the tool of FIG. 1 in the recessed and extended positions, respectively.
Figure 4B:
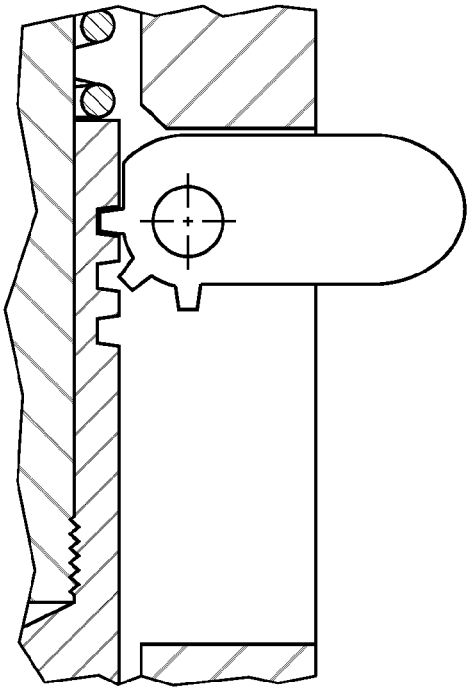

At a predetermined distance from the upper slots 22 is the lower set of slots 24 and a set of centering blades 48. In the idle position, the centering blades 48 are recessed into the slots 24 in a generally parallel orientation to the longitudinal axis of the body 12. As illustrated in FIG. 4, each of the centering blades 48 has an elongated rectangular cross section and has openings 28 for receiving pivotal pins 59. Each centering blade 48 has teeth 66 on its heel. The bottom portion 61 of each centering blade 48 is machined to have a radius to engage the inside diameter of a casing 60 to be cut or milled.

Figure 6:
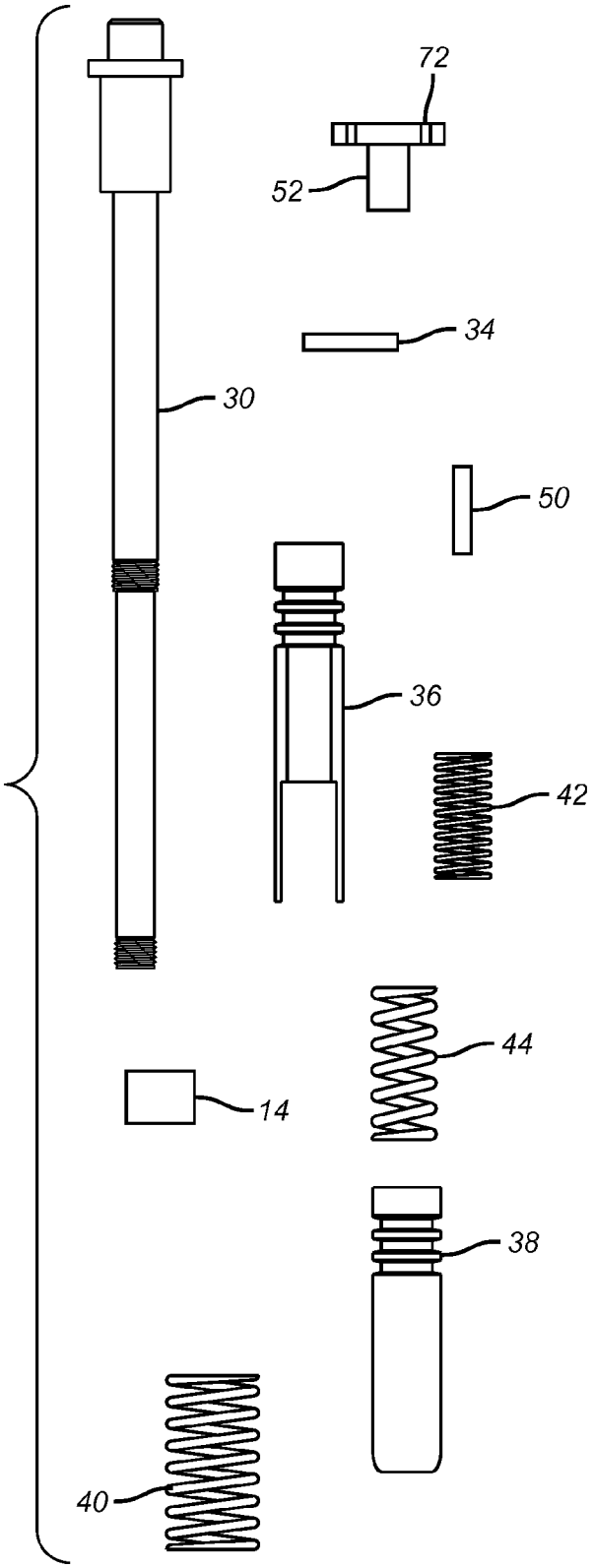
FIGS. 6 and 6*a* are respectively a cross-sectional view of a tubular shaft assembly of the cutting tool of FIG. 1 and an exploded view of its components.
Figure 6A:
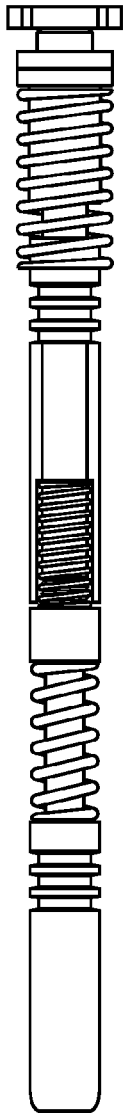

FIGS. 6 and 6*a* illustrate a tubular shaft assembly of the tool 10 that includes an elongated, cylindrical mandrel 30. The mandrel 30 is hollow to allow regulated fluid to pass through the cutter. On the top of mandrel 30 is a machined hollow portion to receive a flotel or flow restriction device 32 (FIG. 1). The flotel 32 is cylindrical and positioned in the top portion of the body 12. The flotel 32 has a stem 52 that mates with the top of the mandrel 30. The flotel 32 also has six to eight holes 72 in its top surface to allow fluid to press against the mandrel 30 at a packing member seat 34. Upper and lower drive sleeves 36 and 38 fit over the upper and lower ends of the mandrel 30, respectively collectively forming a mandrel assembly with the associated springs as further explained. The upper and lower drive sleeves 36 and 38 are held in position by springs 42 and 44, respectively separated by a spacer 14. The mandrel 30 is held in position by a spring 40.

Figure 3:
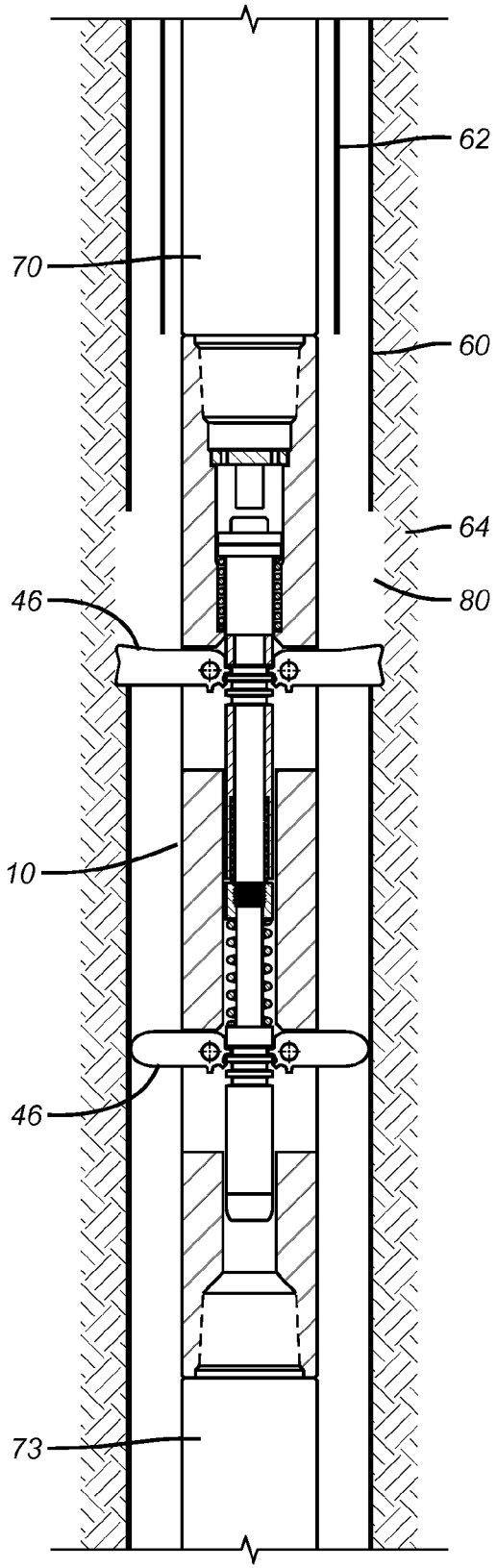
FIG. 3 is a cross-section view of the cutting tool of FIG. 1 in use.
Figure 5A:
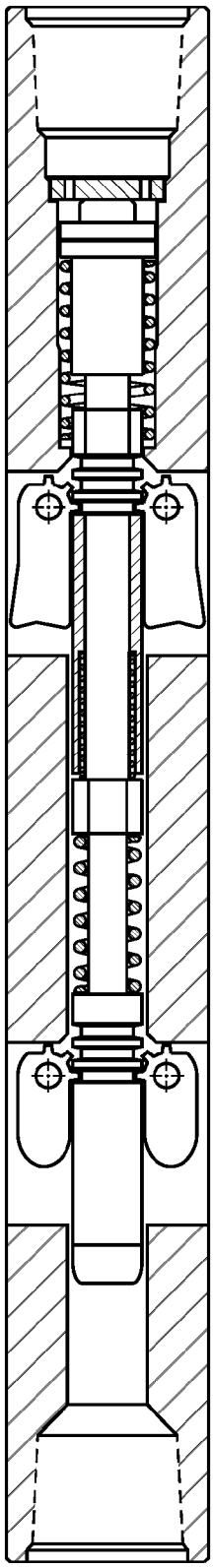
FIGS. 5*a*-5*c* illustrate respectively illustrate an operating sequence of the tool of FIG. 1 in the run in, centering blades extended and cutting blades extended positions.
Figure 5B:
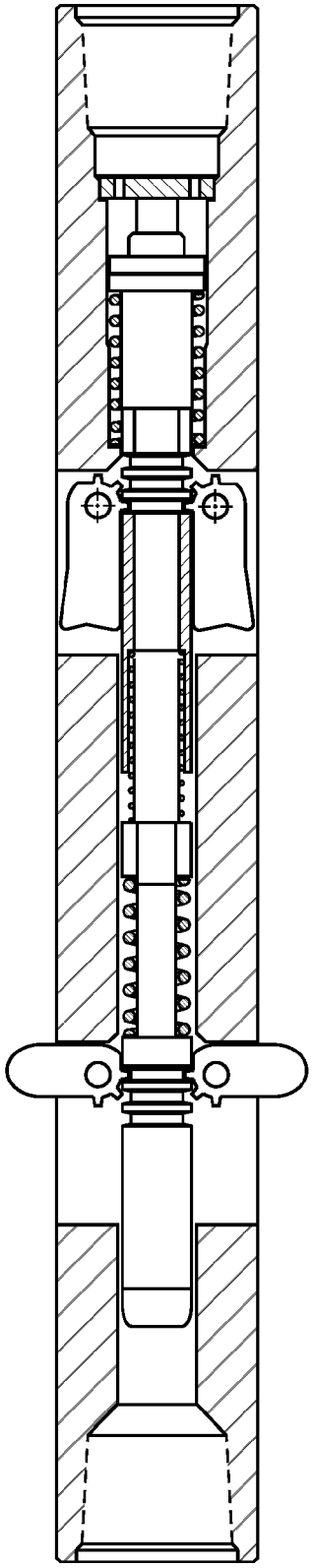
Figure 5C:
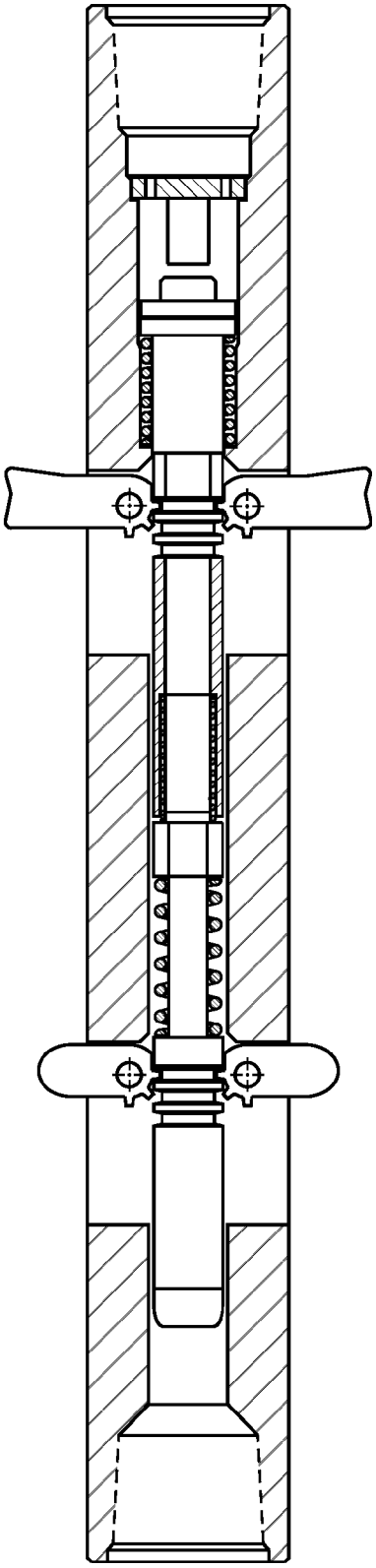

Referring to FIGS. 3 and 5, in operation the tool 10 is fitted with the proper cutting blades 46 and centralizing blades 48 to perform the cutting or milling operation in the casing 60. The tool 10 is lowered through the smallest restriction in either the casing 62 or wellhead to a depth selected for the performance of the cutting/milling operation. The body 12 of the tool 10 is caused to rotate in the casing 60, while fluid pressure on the mandrel 30 causes the lower drive sleeve 38 to engage the teeth 66 of the centering blades 48. Continued downward movement of the piston on the lower drive sleeve 38 causes the centering blades 48 to extend outward perpendicular to the body 12 and thus to cause the tool 10 to become centered in the casing 60. As the body 12 continues to turn and fluid continues to press on the piston seal 34, the mandrel 30 moves further downward and causes the upper drive sleeve 36 to engage the teeth 54 of the cutting blades 46 and causes the cutting blades 46 to extend outward from the body 12. This combined movement causes the cut out edges 56 of the cutting blades 46 to cut through the casing 60 until the blades 46 are perpendicular to body 12 and the casing is severed. With the tool 10 still rotating, downward pressure continues on the tool 10, which is still centered in the casing 60 by the centering blades 48, causing a window 80 to be cut in the casing 60 and into the formation 64 of the desired length and enabling a plug to be set.

It should be understood, of course, that the foregoing relates to exemplary embodiments of the invention and that modifications may be made without departing from the spirit and scope of the invention as set forth in the following claims.

I claim:

1. A tool for cutting tubular at a subterranean location, comprising:

a stationary housing;

at least one extendable cutting blade pivotally mounted on a fixed pivot on said housing;

at least one extendable centering blade pivotally mounted on a fixed pivot on said housing;

said centering blade extends to the tubular before said cutting blade;

said housing has a passage therethrough with a movable mandrel assembly disposed in said passage;

said mandrel assembly further comprising a mandrel sequentially moving spaced drive sleeves respectively associated with said centering blade and said cutting blade for extension of said centering blade before said cutting blade.

2. The tool of claim 1, wherein:

said cutting and centering blades are axially spaced on said housing.

3. The tool of claim 1, wherein:

said mandrel assembly responsively moves to applied pressure in said passage.

4. The tool of claim 1, wherein:

said mandrel assembly is operatively connected to said cutting and centering blades such that axial movement of said mandrel assembly rotates said cutting and centering blades about respective pivotal connections for said cutting and centering blades.

5. The tool of claim 4, wherein:

said mandrel assembly is connected to said cutting and centering blades with respective rack and pinion assemblies.

6. The tool of claim 5, wherein:

said rack for said cutting and centering blades is located on said mandrel and said pinion for said cutting and centering blades is located at an end of said cutting and centering blades.

7. The tool of claim 6, wherein:

said cutting and centering blades are pivotally mounted in wall openings in said housing.

8. The tool of claim 3, wherein:

said mandrel assembly comprises a flow restriction in said passage that responds to flow therethrough with an applied axial force to said mandrel assembly.

9. The tool of claim 1, wherein:

said drive sleeves are axially spaced and a biasing member is associated with each said drive sleeve.

10. The tool of claim 9, wherein:

applied pressure in said passage overcomes said biasing member associated with said centering blade at a first predetermined pressure to extend said centering blade whereupon a further increase in pressure in said passage overcomes said biasing member associated with said cutting blade for subsequent extension of said cutting blade from said housing.

11. The tool of claim 10, further comprising:

a mandrel assembly return spring to move said mandrel assembly axially for retraction of said cutting and centering blades on removal of pressure from said housing.

12. The tool of claim 10, wherein:

removal of pressure in said passage allows said biasing members to sequentially retract said cutting blade followed by said centering blade.

13. The tool of claim 1, wherein:

said at least one cutting blade comprises a plurality of circumferentially spaced cutting blades;

said at least one centering blade comprises a plurality of circumferentially spaced centering blades.

14. The tool of claim 13, wherein:

said centering blades have arcuate ends.

15. The tool of claim 13, wherein:

said cutting blades comprise a cut out side and a milling edge with carbide inserts extending to adjacent a periphery of said blades.

16. The tool of claim 13, wherein:

said plurality of cutting blades and said plurality of centering blades are fully retracted into housing openings for run in.

17. The tool of claim 13, wherein:

said plurality of cutting blades and said plurality of centering blades are pivotally mounted to said housing and actuated with an axially movable mandrel assembly in a passage of said housing through a rack and pinion operable connection between said mandrel assembly and said plurality of cutting blades and said plurality of centering blades.

* * * * *